US005967068A

United States Patent [19]

Landoni

[11] Patent Number: 5,967,068

[45] Date of Patent: Oct. 19, 1999

[54] MULTI-NEEDLE KNOTTED-STITCH QUILTING MACHINE WITH LOWER STITCHING ELEMENTS HAVING ROTATING HOOKS

[76] Inventor: Giannino Landoni, Strada Prov. Busto/Cassano M., 3 - 21054 Fagnano Olona (VA) -, Italy

[21] Appl. No.: 09/009,132

[22] Filed: Jan. 20, 1998

[30] Foreign Application Priority Data

Mar. 28, 1997 [IT] Italy ..... UD97A0055

[51] Int. Cl.[6] ..... D05B 11/00; D05B 1/08

[52] U.S. Cl. ..... 112/117; 112/166

[58] Field of Search ..... 112/117, 118, 112/119, 163, 167, 164, 165, 166, 470.01, 470.06, 470.12, 470.13, 155

[56] References Cited

U.S. PATENT DOCUMENTS

| | | | |
|---|---|---|---|
| 2,483,466 | 10/1949 | Johnson . | |
| 4,226,196 | 10/1980 | Booth | 112/163 X |
| 5,167,195 | 12/1992 | Guerreschi | 112/155 |
| 5,249,536 | 10/1993 | Hattori et al. . | |
| 5,676,077 | 10/1997 | Landoni | 112/166 X |

FOREIGN PATENT DOCUMENTS

| | | |
|---|---|---|
| 1526750 | 9/1968 | France . |
| 1146341 | 3/1963 | Germany . |
| 7148366 | 6/1995 | Japan . |

*Primary Examiner*—Peter Nerbun
*Attorney, Agent, or Firm*—Stevens, Davis, Miller & Mosher, L.L.P.

[57] ABSTRACT

Multi-needle quilting knotted-stitch machine with lower stitching elements having rotating hooks, the machine comprising an inlet assembly for the controlled feed of the textile material (11) to be quilted, a stitching assembly including upper stitching elements (12) and lower stitching elements and an outlet assembly for the collection and possible measurement and cutting of the quilted product (19). The upper stitching elements including at least two parallel bars (13) arranged lengthwise and supporting, in a position separated lengthwise, the relative stitching needles (24), the lower stitching elements of rotating hooks (17) being organized in longitudinal rows mating with the position of the relative needle-carrier bar (13), the position of each needle (24) corresponding to the position of a respective rotating hook (17). The quilting machine including the rotating hooks (17) assembled, spaced lengthwise at a defined assembly distance, on respective faces (116*a*, 116*b*) of at least two longitudinal bars (16*a*, 16*b*), at least one of the hook-carrier bars (16*a*, 16*b*) being able to be displaced lengthwise with respect to the other bar (16*b*, 16*a*) by a value (D) equal to a desired sub-multiple of the assembly distance of the rotating hooks (17) on the relative bar (16*a*, 16*b*).

20 Claims, 4 Drawing Sheets

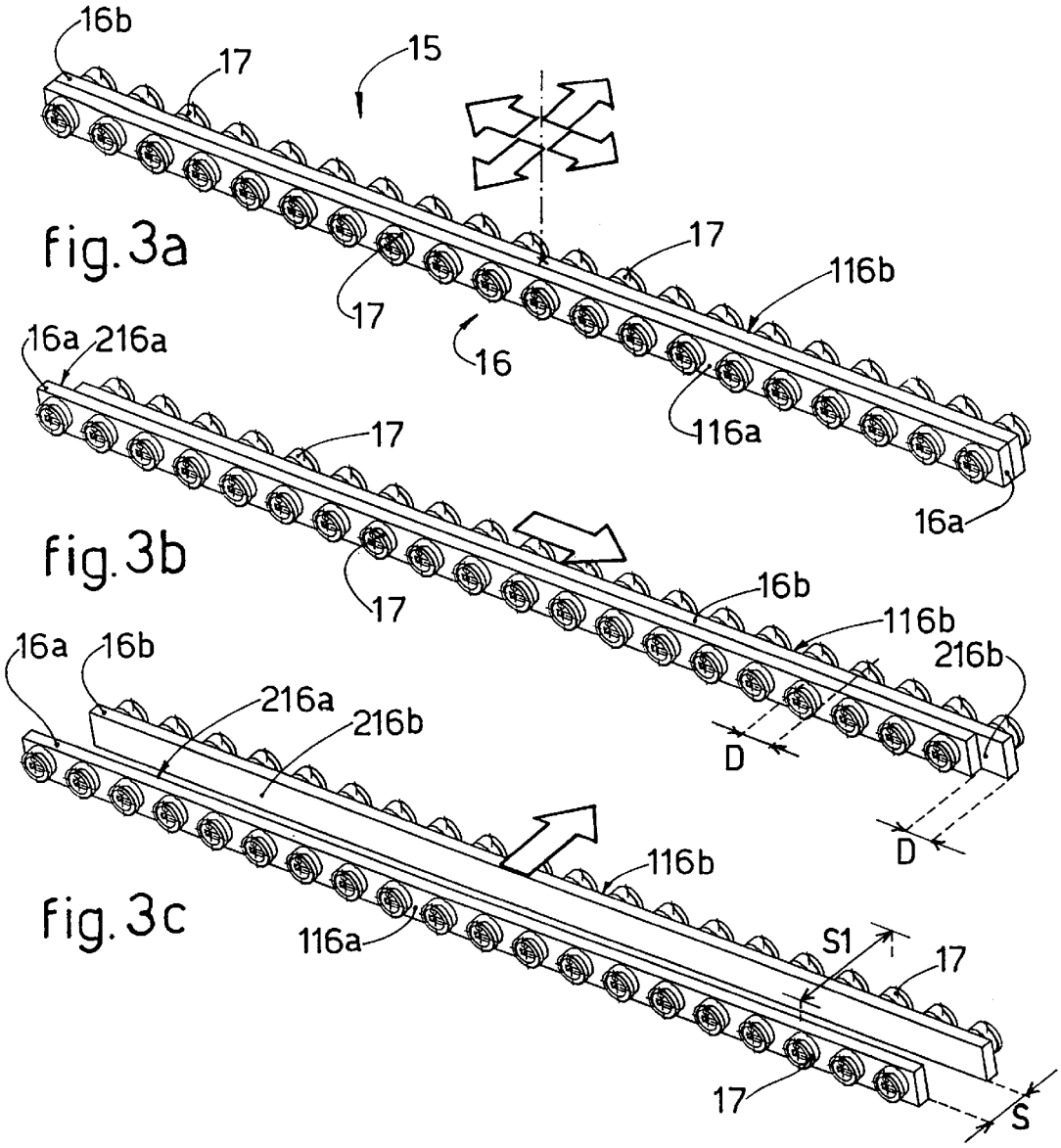
fig.3a
fig.3b
fig.3c
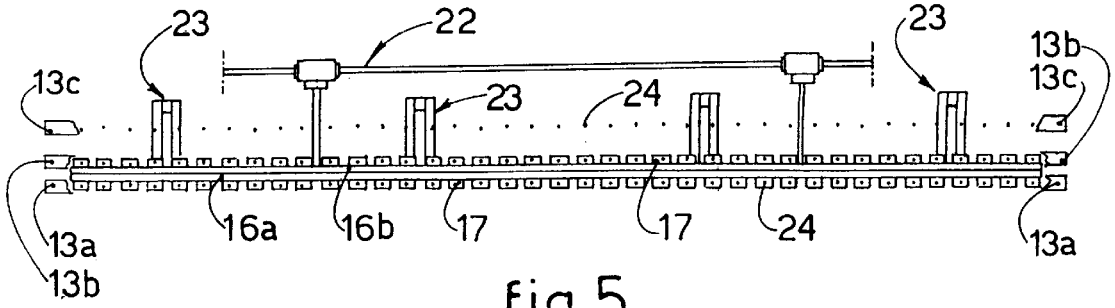
fig.5

MULTI-NEEDLE KNOTTED-STITCH QUILTING MACHINE WITH LOWER STITCHING ELEMENTS HAVING ROTATING HOOKS

FIELD OF THE INVENTION

This invention concerns a multi-needle knotted-stitch quilting machine with lower stitching elements having rotating hooks.

The invention is applied in textile, furnishing and clothing industries, to make multi-layered quilted textile products, consisting of at least an outer fabric and at least an inner supporting and/or padding layer associated together by means of lines of stitching achieved simultaneously to make desired designs or patterns.

The multi-needle quilting machine according to the invention makes it possible to achieve any kind of pattern, even very sophisticated, similar to embroidery and made with stitches placed even very close together.

Moreover, with the multi-needle quilting machine according to the invention it is possible to make both small and large patterns, and every type of stitch, both single, double, triple, intercalated, double raised, etc.

BACKGROUND OF THE INVENTION

The state of the art covers multi-needle quilting machines employed in the textile industry to make quilted products with the knotted-stitch technique.

These quilting machines generally comprise:

- an inlet assembly to feed the multi-layered fabric which is to be quilted, for example consisting of an outer fabric and at least an inner layer of supporting and/or padding material;
- a stitching assembly including upper stitching elements and lower stitching elements;
- an outlet assembly to collect and/or measure and/or cut the semi-finished quilted product.

The upper stitching elements of the stitching assembly generally consist of parallel longitudinal bars endowed with alternating ascending/descending motion and bearing a plurality of needles which are spaced lengthwise at a fixed distance.

Each of the needles is associated with a respective stitching thread, denominated needle thread, and cooperates with a mating gripping means provided on the lower stitching elements.

Each gripping means has a respective stitching thread denominated bobbin thread.

The gripping means grasp the eyelet or heddle eye, of the needle thread and weave it in the desired manner with the bobbin thread in order to achieve the desired type of stitch.

In quilting machines of this type, with the knotted-stitch, the gripping means can be of two types: shuttle type or the type with rotating hooks (crochet).

In the first system, a plurality of shuttles are used, each one carrying a respective bobbin or spool of thread, which are made to move alternately forwards and backwards on sliding guides with substantially straight movements coordinated with the ascending/descending movements of the needle-carrier bars.

Quilting machines of the shuttle type technology include one, two or three upper needle-carrier bars, each one cooperating with a respective lower row of shuttles.

When three needle-carrier bars are used, only two of them are used at the same time; the two nearest bars are used to make small or average size designs, and the two farthest bars to make large designs.

Given the space occupied by the shuttles, with this type of quilting machine it is possible to make quilted products with designs which are quite complex, but characterized by lines of stitches whose distance cannot be less than the transverse size of the shuttles and/or the space occupied by the sliding guides.

In multi-needle, shuttle-type quilting machines, it is however possible to mount one needle every inch (2.5 cm) on the relative needle bar, so as to achieve, for example, lozenges or diamonds 1 inch across.

However, the great inertia of the alternative motion of the shuttles and the sliding friction of the shuttles on the relative sliding guides limits the highest attainable speed of this type of machine to about 600 stitches per minute.

Shuttle-type quilting machines, moreover, include other disadvantages including rapid wear of the shuttles, overheating due to friction between the guides and the shuttles, long downtimes to replace the finished bobbins, and also other problems.

Quilting machines with rotating hooks on the one hand do not have the above problems and offer higher productivity due to the higher speeds which can be obtained (up to 1000÷1200 stitches per minute using rotation guides made of particular anti-friction materials), but on the other hand they do not enable quilted articles with very small designs to be achieved.

This is because of the considerable size of the hooks which prevent a closer positioning beyond the physical limit.

The distance of the lines of stitches is linked to the physical size of the hook itself, and, in machines known to the state of the art, it has therefore never been possible to make, at the same time and with all the lower stitching elements, designs with a distance between the needles of about 2.5 cms (1 inch).

Moreover, because of the considerable space occupied by the hooks and factors connected with the cost of a bar of the hooks, it has not been possible so far to achieve competitive multi-needle quilting machines with more than two rows of hooks, and therefore more than two needle-carrier bars, and therefore it has never been operationally possible to achieve, on the same machine, both large and small designs.

It is known that the stitching pattern is defined by the reciprocal position assumed by the needles with respect to the movement of the material.

This reciprocal position obviously determines the size of the pattern achieved.

For example, in order to make diamond shapes of 6 inches across, two parallel needle bars are used with needles mounted every 6 inches; these needles are staggered and the needles of one bar are intercalated with the needles of the other bar.

The material which is to-be quilted is then moved with a continuous movement forwards-left-right-left, wherein every sideways movement covers a space of three inches, so that the edges of the zig-zag stitches (3 inches wide) made by the needles of the first needle bar touch the edges of the zig-zag stitches (also 3 inches wide) made by the second needle bar, thus creating a continuous quilting of diamonds 6 inches across.

In a similar manner, in order to achieve diamonds 3 inches across, needles separated from each other by a distance of 3 inches must be mounted on the relative needle bars.

In order to achieve larger designs, for example 12 inches across, the machine must have three needle bars separated transversely from each other by 3 inches, wherein the two outer needle bars have their needles separated from each other by 12 inches, and the needles of the first bar are intercalated with the needles of the third bar.

The forwards-left-right-left movement of the material to be quilted will therefore be 6 inches for every step.

The second, intermediate needle bar in this case is excluded from the quilting cycle, but installation costs are considerably increased, given the high costs of the hooks.

Consequently, quilting machines with rotating hooks as are known to the state of the art do not make possible to achieve quilted products with close lines of stitches so as to make attractive designs or patterns which will be requested by consumers.

In such machines moreover, since the rows of lower stitching elements are stationary and very far from each other, in order to vary the size or the profile of the desired design it takes a long time to equip them, particularly to re-insert or replace the bobbin of thread associated with the respective hooks.

To change the size of the design it is necessary to mount a greater or lesser number of needles, and the corresponding hooks, in the prescribed fixed and unchangeable positions at the pre-determined distances on the respective bars.

Document FR-A-1.523.750 shows a multi-needle quilting machine with rotating hooks; the innovation is substantially that the hooks are mounted with their axes parallel to the needle bars, rather than perpendicular, the hooks being supported by oscillating arms so as to enable the bobbin to be replaced quickly.

The hooks, moreover, have toothed rings on the outer circumference which, as they engage mating toothed wheels mounted on a central shaft, make them rotate.

The purpose of FR'750 is to reduce as much as possible the distance between the hooks.

However, the positions of the hooks remain fixed and cannot be changed; moreover, using rotating hooks with an axis parallel to the needle bars makes it impossible to use pairs of needles working with a single hook in order to make double line stitching.

Document JP 71-48366 shows a system to mount eccentrics to drive the needles in a multi-needle quilting machine with one needle bar and rotating hooks, in such a way that the lateral size of the hooks is as limited as possible so as to reduce the distance between two adjacent needles.

In this case too the hooks are mounted with their axis of rotation parallel to the needle bar and their position is fixed and cannot be changed.

U.S. Pat. No. 5,249,536 shows an embroidering machine with multiple heads; the principal innovation is that there is a system to hold and cut the ends of the threads after stitching.

U.S. '536 also shows a system, now abandoned in modern embroidering machines, to make a head-bearing bar pass in order to vary the colour of the thread to be coupled with the fixed needle.

This document has no relevance to the present invention.

U.S. Pat. No. 2,483,466 shows a multi-needle quilting machine with one needle bar, presumably with rotating hooks; the innovation is that there is a mechanical system to move the materials which are to be quilted under the stationary needles so as to achieve patterns of a substantially circular shape.

The position of the hooks is stationary and cannot be changed.

Finally, DE-A-1.146.341 shows a multi-needle quilting machine with one needle bar; the innovation lies in the direction of feed of the materials to be quilted, that is to say, they are fed in the opposite direction to the one used in conventional machines.

In this case too, the position of the hooks is stationary and cannot be changed.

It is clear from the above that not one of the prior art documents is able to provide a solution, even a partial one, to the shortcomings described.

SUMMARY OF THE INVENTION

The present applicant has designed, tested and embodied this invention in order to overcome the shortcomings of the state of the art, which businessmen in the field have long complained of, and also to achieve further advantages.

The purpose of the invention is to provide a multi-needle knotted-stitch quilting machine which provides a simple and inexpensive solution to make quilted products characterized by designs which may even be very complex, substantially unprecedented with regard to pattern and size and which cannot be obtained with traditional machines, with the lines of stitches extremely close together.

A further purpose of the invention is to use a single machine to make both small and large designs, and also designs of original size, for example midway between large and small, with a simple and rapid automatic reconfiguration of the position of the upper and/or lower stitching elements.

A further purpose is to use a multi-needle quilting machine with three bars of needles associated with only two bars of rotating hooks, thus allowing small and large designs to be achieved on the same machine, without the extra expense of a third bar which, in the stitching cycles, even if it is not used, still has the hooks rotating so that the risks of damage and wear still persist.

A further purpose is to provide a machine which is able to make any type of stitch, either single, double, intercalated, double raised, etc., and any type of design even similar to embroidery allowing two needles to cooperate with a single rotating hook.

The multi-needle quilting machine according to the invention includes a stitching assembly with upper stitching elements comprising one, two or three needle-carrier bars and lower stitching elements of the rotating hooks type.

To be more exact, the lower stitching elements consist of two hook-carrier bars associated with each other and positioned, at least in a first step of the stitching cycle, in correspondence with the needle-carrier bars above.

According to a first embodiment, the machine according to the invention includes two hook-carrier bars and two respective needle-carrier bars.

According to a variant, the machine includes two hook-carrier bars and three needle-carrier bars.

The rotating hooks of the at least two hook-carrier bars are cantilever mounted and axially distanced along a relative longitudinal face. The bars have at least a first reciprocal working position where all the relative hooks are arranged counter-opposed to each other.

According to the invention, at least one of the hook-carrier bars can be translated at least lengthwise with respect to the other hook-carrier bar.

According to a variant, the hook-carrier bar can also be translated transversely with respect to the other hook-carrier bar.

According to another variant, a first hook-carrier bar can be translated transversely and the other hook-carrier bar can be translated lengthwise.

By means of the lengthwise displacement of at least one of the hook-carrier bars with respect to the other which remains stationary, it is possible to disalign, by desired values, the axis of each hook on the first hook-carrier bar from the axis of the respective hook on the second hook-carrier bar.

By means of this lengthwise displacement of the hooks, it is possible to make the needles on a first needle-carrier bar work in a position which is not even transversely aligned with the respective needles of the other bar.

In this way it is possible to vary the distance between adjacent lines of stitches to minimum values smaller than the space occupied by the hooks, something which is not possible in the multi-needle quilting machines known at present.

According to the invention, therefore, the needle-carrier bars and the needle plates have seatings to support the needles and the holes through which the needles pass arranged at a distance which is a sub-multiple of 2.5 cms, reaching values for the interaxis distance as low as 2.5 mms, thus permitting a substantially unlimited plurality of positions for the hooks and allowing the machine to be rapidly adapted for the designs to be made.

By means of the transverse displacement of one hook-carrier bar with respect to the other which remains stationary, it is possible to take the movable hook-carrier bar into correspondence with the third and most distant hook-carrier bar according to the design to be achieved.

It is thus possible to use quilting machines with rotating hooks with three needle-carrier bars cooperating with only two hook-carrier bars, thereby simplifying the machine and obtaining a significant saving, given the high individual cost of the hooks, since there is a hook-carrier bar which is not used.

According to a variant, at least one of the needle-carrier bars can be displaced at least transversely, in such a way as to achieve designs of an intermediate size, between large and small.

According to another variant, at least one, and advantageously all, of the needle-carrier bars can be displaced lengthwise according to the displacement of the mating hook-carrier bar, so as to avoid the need to reposition the needles as a hook-carrier bar is displaced lengthwise.

When it is desired to pass from the small design configuration to the large design configuration, the hook-carrier bar which can be displaced transversely is displaced and aligned with the third and farthest needle-carrier bar while the other remains stationary in position.

This solution also eliminates downtimes due to the reinsertion and replacement of the bobbins as required in the state of the art each time the configuration of the machine is changed.

According to the invention, each hook-carrier bar cooperates with respective motor means suitable to make all the hooks mounted on the bar rotate simultaneously and in synchrony with the ascending/descending movements of the needle-carrier bar.

According to a variant, the hook-carrier bars cooperate with braking means which allow the hooks to be maintained in step with each other both during the downtimes of the machine and also during the equipping step and also during the lengthwise and/or transverse translations of at least one of the hook-carrier bars.

According to one possible embodiment, the braking means cooperate at least with the motor means of the hook-carrier bars.

According to the invention, the hook-carrier bars cooperate with longitudinal guide means and transverse guide means and are advantageously but not exclusively of the servo controlled type, thus enabling the equipping and adaptation operations to be rapid and automatic.

According to a possible embodiment of the invention, the translation movements of the hook-carrier bars take place in step.

With this invention, thanks to the fact that it is possible to reduce to a minimum the longitudinal distance between the hooks mounted on the different bars, and to use pairs of needles which work with the same hook, it is possible to achieve double stitches in a position of proximity, as little as 2.5 mm, normal or raised, in which the threads of two adjacent needles are knotted by the thread of a single hook.

The multi-needle quilting machine according to the invention includes means to feed the material which is to be quilted, electronically controlled and managed by software which allows any type of quilting design to be achieved.

BRIEF DESCRIPTION OF THE DRAWINGS

The attached figures are given as a non-restrictive example and show a preferential embodiment of the invention as follows:

FIGS. 3*a*, 3*b*, 3*c* show respectively three possible configurations of the lower stitching elements of the machine in FIG. 1;

FIG. 5 shows a part view from above of FIG. 2;

DETAILED DESCRIPTION OF THE PREFERRED EMBODIMENTS

Figure 1:
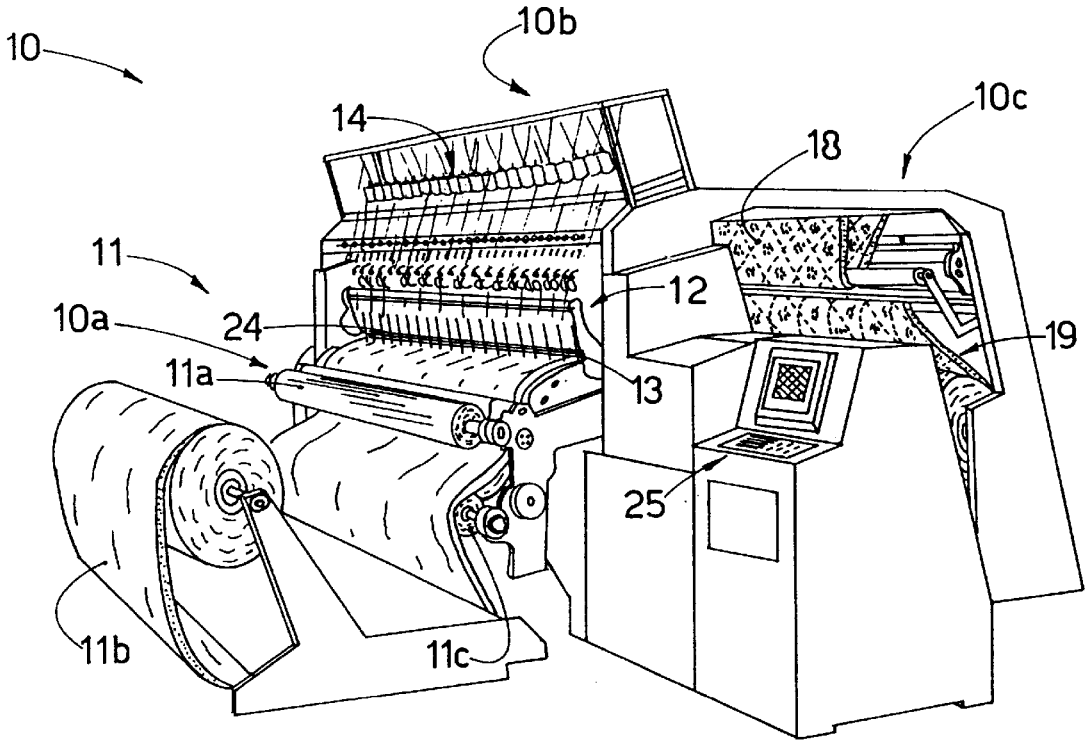
FIG. 1 shows a three-dimensional view of a multi-needle quilting machine according to the invention.

FIG. 1 shows a multi-needle quilting machine according to the invention.

The multi-needle quilting machine 10 comprises, in its essential parts, an inlet assembly 10*a*, a stitching assembly 10*b* and an outlet assembly 10*c*.

The inlet assembly 10*a* is used to feed the textile material 11 which is to be quilted; the material 11 in this case consists of an upper fabric 11*a*, a lower fabric 11*c* and an intermediate layer of support and padding 11*b* so as to constitute a so-called "quilted sandwich".

The inlet assembly 10*a* is managed and controlled by a software unit and is therefore able to move the textile materials 11 in whatsoever direction so as to achieve quilted products 19 with designs which may even be very complex.

The stitching assembly 10*b* comprises upper stitching elements 12 consisting of needle-carrier bars 13 which are parallel to each other, in this case three in number, respectively 13*a*, 13*b* and 13*c*, cooperating with mating lower stitching elements 15.

The needle-carrier bars 13 are associated with respective movement arms 26 equipped with alternate ascending/descending motion and comprise a plurality of stitching needles 24 each of which cooperates with a respective thread 14, known as needle thread.

The cooperation between the upper stitching elements 12 and the lower stitching elements 15 causes the simultaneous formation on the textile material 11 of a plurality of stitches 18 to achieve the desired designs to obtain the quilted textile product 19 which is then collected in the desired manner at the outlet assembly 10*c*.

According to the invention, the assemblies 10*a*, 10*b* and 10*c* are controlled and activated by an electronic control unit 25 equipped with interface means, such as key board, display, possible peripheral printer machines or otherwise, with which the operator of the multi-needle quilting machine 10 can interface.

In this case, the lower stitching elements 15 consist of two parallel hook-carrier bars 16 arranged in a mating position with two of the needle-carrier bars 13 above.

Each of the hook-carrier bars 16, respectively the first bar 16*a* and the second bar 16*b*, cantilever support a plurality of rotating hooks 17, substantially of a structure and function known to the state of the art, which have an axis of rotation substantially perpendicular to the relative bar 16*a*, 16*b*.

Figure 3D:
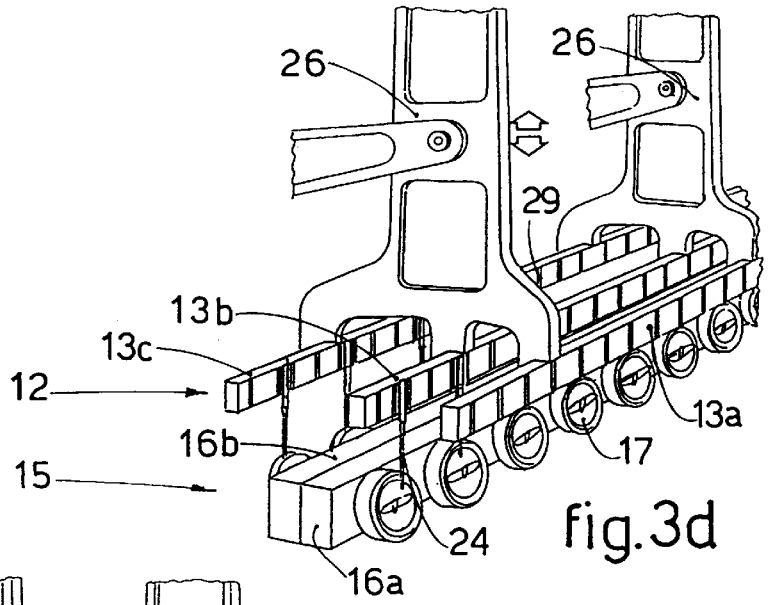
FIGS. 3*d*, 3*e*, 3*f* show respectively the lower stitching elements in the configurations shown in FIGS. 3*a*, 3*b*, 3*c* when placed in cooperation with the upper stitching elements.

In this case, the rotating hooks 17 are assembled in alignment along the length of the outer side 116*a* and the outer side 116*b* of the relative hook-carrier bar 16*a* and 16*b*; the inner sides 216*a* and 216*b* of the hook-carrier bars 16*a* and 16*b* are therefore counter-opposed, so that the two hook-carrier bars 16*a* and 16*b* include at least a first working position where they are specular (FIGS. 3*a*, 3*d*).

Figure 2:
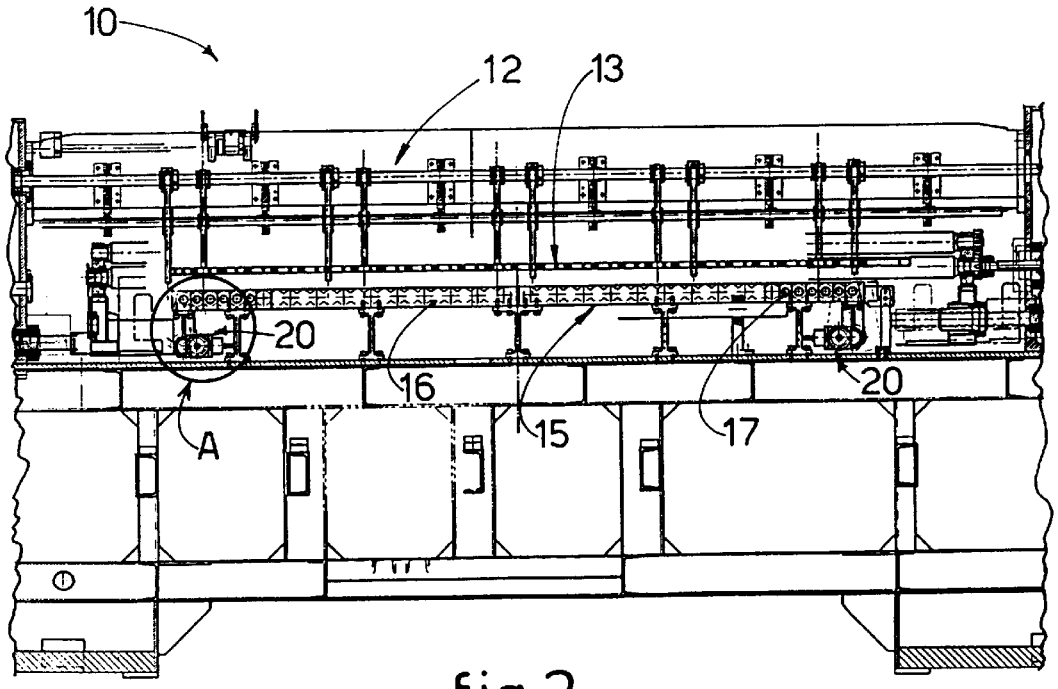
FIG. 2 shows a longitudinal section of the machine in FIG. 1.
Figure 4:
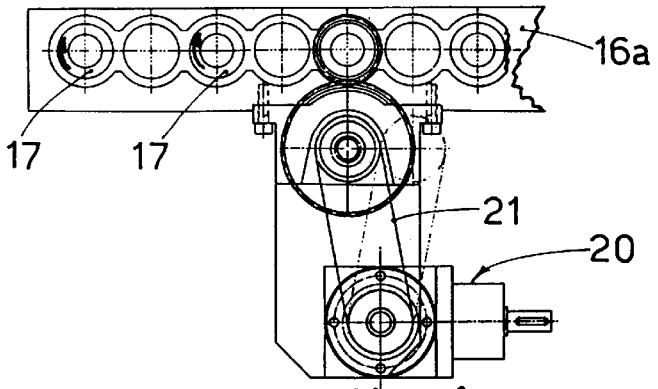
FIG. 4 shows a part view of the enlarged detail A of FIG. 2.

Each hook-carrier bar 16 cooperates with a respective motor means 20, in this case including a belt 21, which is suitable to make the hooks 17 rotate simultaneously, in step with each other and in synchrony with the alternating ascending/descending movements of the needles 24 of the respective needle-carrier bars 13 (FIGS. 2, 4).

In this case, the hook-carrier bar 16*b* can be displaced both lengthwise and transversely with respect to the other hook-carrier bar 16*a* which remains stationary. According to a variant, not shown here, both the hook-carrier bars 16*a* and 16*b* can be translated both lengthwise and transversely.

According to a further variant, not shown here, the hook-carrier bar 16*a* or 16*b* can be translated only lengthwise and the other hook-carrier bar 16*b* or 16*a* can only be translated transversely.

In the case shown here, the hook-carrier bar 16*b* includes a first working position (FIGS. 3*a*, 3*d*) where it is in contact with the bar 16*a* and where the respective hooks 17 are counter-opposed to the hooks 17 on the hook-carrier bar 16*a*.

In this position, the hook-carrier bars 16*a* and 16*b* cooperate with the nearest needle-carrier bars 13*a* and 13*b* (FIG. 3*d*) so as to achieve small designs and with lines of stitches placed at a distance of no less than 2.5 cm (1 inch).

Figure 3E:
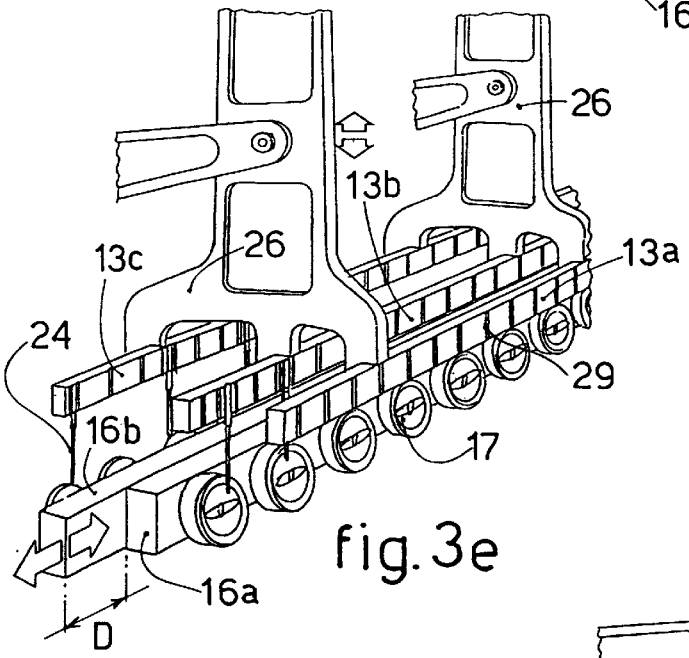

The hook-carrier bar 16*b* can also have a second working position (FIGS. 3*b*, 3*e*) which is disaligned lengthwise from the bar 16*a* by a value D, so as to take the respective hooks 17 to a staggered position with respect to the hooks 17 on the hook-carrier bar 16*a*.

This disaligned position makes it possible to achieve small designs, given the reciprocal transverse position of the bar 16*a*, 16*b*; however, the lines of stitches which can be achieved are closer, at a distance which is a sub-multiple of 2.5 cm, according to the value of the staggering of the relative hooks 17.

In this configuration where the hooks 17 are disaligned, the needles 24 of the needle-carrier bar 13*b* will be positioned in coordination with the new position assumed by the hooks 17, using auxiliary seatings 29 which are arranged in an opportune manner on the needle-carrier bar 13*b*.

Figure 3F:
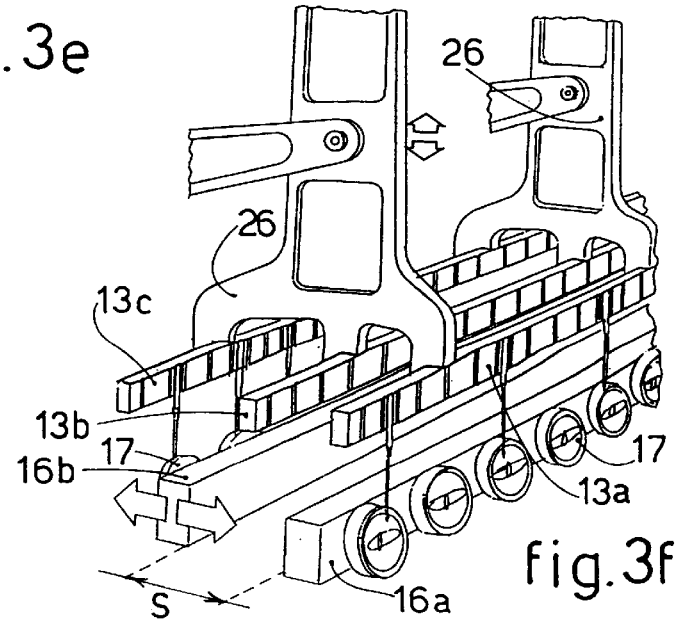
Figure 7:
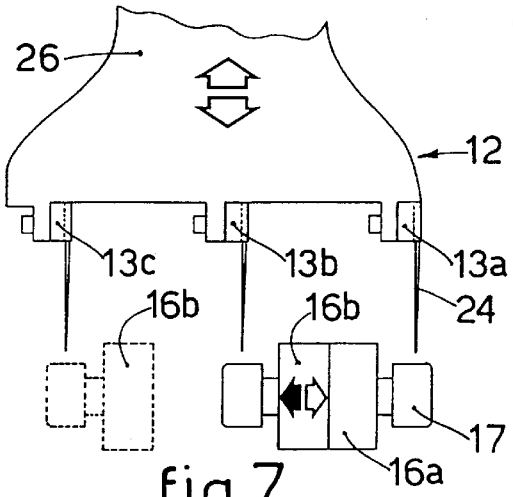
FIG. 7 is a part view from the side of FIG. 5.

The hook-carrier bar 16*b* can, moreover, have a third working position, transversely displaced by a value S with respect to the hook-carrier bar 16*a*, in such a way as to allow it to be positioned in correspondence with the third and farthest needle-carrier bar 13*c* so as to achieve large size designs (FIGS. 3*c*, 3*f*, 7).

Figure 6A:
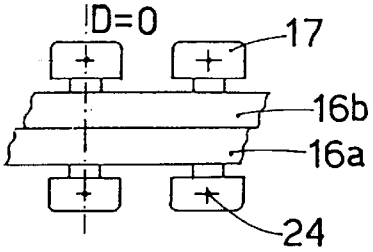
FIG. 6*a* shows a part view of an enlarged detail of the lower stitching elements shown in FIG. 5.
Figure 6B:
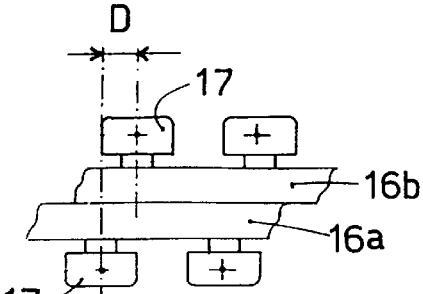
FIGS. 6*b* and 6*c* show variants of FIG. 6*a;*
Figure 6C:
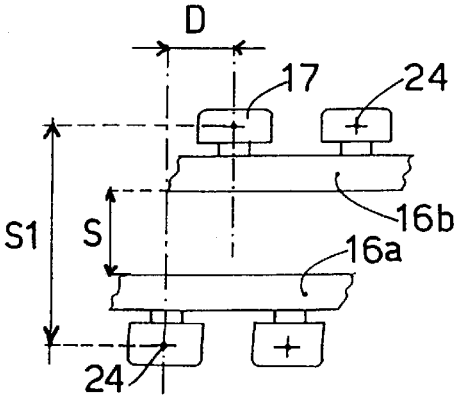

The lengthwise and transverse displacements moreover can be combined to obtain large designs with close lines of stitches, or any other type of combination desired. A new value of transverse distance S1 of the hooks 17 (FIG. 6*c*) corresponds to the value S of transverse displacement referred to the bars 16*a*, 16*b*.

Figure 8:
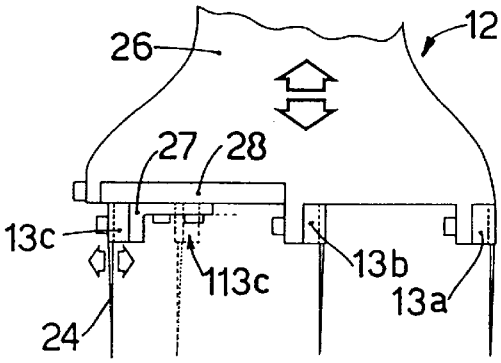
FIG. 8 shows a variant of FIG. 7.

According to the variant shown in FIG. 8, at least one of the needle-carrier bars 13*a*, 13*b*, 13*c* can be moved in a transverse direction, in this case the needle-carrier bar 13*c*.

This solution, where the needle-carrier bar 13*c* has a transversely displaced position shown by a line of dashes 113*c*, makes it possible to achieve designs of an intermediate size, between the small designs made with the needle-carrier bar 13*a* and 13*b*, and the large designs made with the needle-carrier bar 13*c* in its position as indicated by the continuous line.

In this case, the transverse movement is achieved by a slider element 27 solid with the needle-carrier bar 13*c* and able to slide along a guide 28.

According to another variant which is not shown here, the needle-carrier bar 13*a* and/or the needle-carrier bar 13*b* can also be displaced transversely.

According to a further variant which is not shown here, at least one of the needle-carrier bars 13*a*, 13*b* and 13*c*, and advantageously all of them, can be moved lengthwise according to the longitudinal movements of the relative hook-carrier bars 16, so as to maintain constantly and automatically the alignment between the needles 24 and the relative hooks 17 in all of their longitudinal positions.

In this way it is possible to considerably reduce the times required for the adaptation and the reconfiguration of the machine in every working position and for every size of the designs to be made.

In this case, the hook-carrier bars 16 are translated automatically by means of servo controls or manually by the operator while the multi-needle quilting machine 10 is being equipped and configured.

During the equipping step, according to the invention, braking means for example of the electromagnetic or pneumatic type are made to intervene; the braking means cooperate at least with the motor means 20 and have the function of maintaining the hooks 17 in step with each other and thus of enabling the multi-needle quilting machine 10 to be restarted again immediately.

In the case shown in FIG. 5, in cooperation with the hook-carrier bar 16*b* there are guide means 22 cooperating in the lengthwise displacement and guide means 23 cooperating in the transverse displacement.

According to one embodiment of the invention, the translations take place in step according to pre-determined values S and D.

According to a variant, the translations take place continuously with values S and D which can be set from time to time by the operator by means of the electronic control unit 25, for example.

According to the invention, the combination of the lengthwise/transverse displacements of a hook-carrier bar 16*b* with respect to the other bar 16*a* with the movements of the textile material 11 given by the inlet assembly 10*a* makes it possible to achieve any kind of stitch whatsoever, and therefore any kind of design or embroidery whatsoever such as it has never been possible to achieve until now with the machines known to the state of the art using the rotating hook technology.

To be more exact, the invention makes it possible to achieve a distance D between the axes of rotation of the corresponding hooks 17, and therefore between the needles 24 of the mating needle-carrier bar 13, less than the size of the maximum space occupied by the hooks 17.

Moreover, by using only two hook-carrier bars 16, it is possible, with this invention, to use three needle-carrier bars 13 so as to obtain designs both of large and small size.

The transverse displacement of at least one of the needle-carrier bars 13 also makes it possible to achieve designs of a size in between the large size and the small size.

The combination of the movements of the hook-carrier bars 16, the provision of multiple seatings 29 on the needle-carrier bars 13, and the possibility of transverse and/or lengthwise displacement of the needle-carrier bars 13 themselves, all these factors make it possible to achieve double stitches of the plain type, the raised type, alternate type, intercalated type, triple stitches or even mixed type, each single, double or triple stitch using the same hook 17.

I claim:

1. A multi-needle knotted-stitch quilting machine with lower stitching elements including rotating hooks, the machine comprising:

an inlet assembly for the controlled feed of textile material (11) to be quilted, a stitching assembly including upper stitching elements (12) and lower stitching elements and an outlet assembly to collect the quilted product (19), the upper stitching elements including stitching needles and at least two parallel needle-carrier bars (13), the needle-carrier bars (13) being arranged lengthwise and each said needle-carrier bar (13) supporting the stitching needles (24) to have the stitching needles (24) mounted spaced lengthwise on respective said needle-carrier bars, the lower stitching elements having rotating hooks (17) organized in longitudinal rows mating with the position of a respective said needle-carrier bar (13), the position of each needle (24) corresponding with the position of a respective rotating hook (17), the machine including the rotating hooks (17) mounted spaced lengthwise at a defined assembly distance on respective faces (116*a*, 116*b*) of at least two longitudinal hook-carrier bars (16*a*, 16*b*), wherein at least one of the hook-carrier bars (16*a*, 16*b*) being supported for displacement lengthwise with respect to the other bar (16*b*, 16*a*) by a value (D) equal to a desired sub-multiple of the assembly distance of the rotating hooks (17) on each respective bar (16*a*, 16*b*).

2. The machine as in claim 1, wherein at least when three needle-carrier bars (13) are used, at least one hook carrier bar (16*a*, 16*b*) can be displaced transversely with respect to the other hook-carrier bar (16*b*, 16*a*), and in this transversely displaced position the at least one hook-carrier bar aligns the relative hooks (17) with the farthest of the needle carrier bars.

3. The machine as in claim 1, wherein one hook-carrier bar (16*b*, 16*a*) can be displaced both transversely and lengthwise with respect to the other hook-carrier bar (16*a*, 16*b*).

4. The machine as in claim 1, wherein a first said hook-carrier bar (16*b*, 16*a*) can be displaced only lengthwise and a second said hook-carrier bar (16*a*, 16*b*) can be displaced only in a transverse direction.

5. The machine as in claim 1, wherein at least one said needle-carrier bar (13*c*) can be displaced transversely with respect to an adjacent said needle-carrier bar (13*b*).

6. The machine as in claim 1, wherein at least one said needle-carrier bar (13*c*) can be displaced lengthwise.

7. The machine as in claim 1, wherein at least one needle-carrier bar (13) includes auxiliary seatings (29) to position needles (24) correlated to a position assumed by the hooks (17) in a displaced position of a respective said hook-carrier bar (16).

8. The machine as in claim 1, wherein to achieve particular close-up stitching, two needles (24) cooperate with a single rotating hook (17).

9. The machine as in claim 1, wherein each said hook-carrier bar (16) is associated with respective motor means (20) to drive all the hooks (17) simultaneously.

10. The machine as in claim 1, which cooperates with an electronic control unit (25) to set the size and profile of the stitch to be obtained.

11. The machine as in claim 1, having means to produce different stitches of large and small size with a distance between relative lines of stitches equal to a desired sub-multiple of the assembly distance of two adjacent hooks (17).

12. The machine as in claim 1, wherein the stitches are independently selected from the group consisting of double stitches, triple stitches, double raised stitches, double plain stitches, and intercalated stitches.

13. The machine as in claim 2, wherein one hook-carrier bar (16*b*, 16*a*) can be displaced both transversely and lengthwise with respect to the other hook-carrier bar (16*a*, 16*b*).

14. The machine as in claim 2, wherein a first said hook-carrier bar (16*b*, 16*a*) can be displaced only lengthwise and a second said hook-carrier bar (16*a*, 16*b*) can be displaced only in a transverse direction.

15. The machine as in claim 2, wherein at least one needle-carrier bar (13*c*) can be displaced transversely with respect to an adjacent needle-carrier bar (13*b*).

16. The machine as in claim 2, wherein at least one said needle-carrier bar (13*c*) can be displaced lengthwise.

17. The machine as in claim 2, wherein at least one needle-carrier bar (13) includes auxiliary seatings (29) to position needles (24) correlated to a position assumed by the hooks (17) in a displaced position of a respective said hook-carrier bar (16).

18. The machine as in claim 2, wherein to achieve particular close-up stitching, two needles (24) cooperate with a single rotating hook (17).

19. The machine as in claim 2, wherein each said hook-carrier bar (16) is associated with respective motor means (20) to drive all the hooks (17) simultaneously.

20. The machine as in claim 2, which cooperates with an electronic control unit (25) to set the size and profile of the stitch to be obtained.

* * * * *